US008348628B2

(12) United States Patent
Hala

(10) Patent No.: US 8,348,628 B2
(45) Date of Patent: Jan. 8, 2013

(54) SYSTEM AND METHOD FOR MONITORING A RECIPROCATING COMPRESSOR

(75) Inventor: Roger A. Hala, Gardnerville, NV (US)

(73) Assignee: General Electric Company, Schenectady, NY (US)

( * ) Notice: Subject to any disclaimer, the term of this patent is extended or adjusted under 35 U.S.C. 154(b) by 1681 days.

(21) Appl. No.: 11/504,063

(22) Filed: Aug. 15, 2006

(65) Prior Publication Data

US 2008/0046196 A1 Feb. 21, 2008

(51) Int. Cl.
*F04B 49/00* (2006.01)

(52) U.S. Cl. ..... 417/63; 417/415

(58) Field of Classification Search ..... 417/63; 73/760, 761, 763, 239, 114.16, 862.621–862.623, 73/766, 168; 92/5; 702/138; 374/187
See application file for complete search history.

(56) References Cited

U.S. PATENT DOCUMENTS

| | | | | | |
|---|---|---|---|---|---|
| 2,455,285 | A | * | 11/1948 | Versaw | 33/785 |
| 2,503,141 | A | * | 4/1950 | Stone | 340/668 |
| 3,242,725 | A | * | 3/1966 | Carrie | 73/761 |
| 3,563,095 | A | * | 2/1971 | Robinson, Jr. | 73/730 |
| 3,844,173 | A | * | 10/1974 | Rockstead et al. | 73/728 |
| 4,152,936 | A | * | 5/1979 | Boykin et al. | 73/198 |
| 4,230,023 | A | * | 10/1980 | Ward | 92/5 L |
| 4,456,963 | A | | 6/1984 | Wiggins | |
| 4,458,514 | A | * | 7/1984 | Bathory | 72/13.4 |
| 4,644,785 | A | * | 2/1987 | Doyle | 73/152.61 |
| 4,669,960 | A | | 6/1987 | Allen, Jr. et al. | |
| 4,736,674 | A | * | 4/1988 | Stoll | 92/5 R |
| 4,848,161 | A | * | 7/1989 | van der Kuur | 73/760 |
| 4,856,347 | A | * | 8/1989 | Johnson | 73/861.72 |
| 5,020,980 | A | * | 6/1991 | Pinkerton | 417/500 |
| 5,038,893 | A | | 8/1991 | Willner et al. | |
| 5,201,851 | A | * | 4/1993 | Holmstrom | 417/415 |
| 5,290,156 | A | * | 3/1994 | Mayland | 417/415 |
| 5,507,253 | A | * | 4/1996 | Lowi, Jr. | 123/56.9 |
| 5,522,303 | A | * | 6/1996 | Stoll et al. | 92/27 |
| 5,808,904 | A | * | 9/1998 | Rasmussen et al. | 702/42 |
| 5,882,384 | A | | 3/1999 | Tom et al. | |
| 5,931,044 | A | | 8/1999 | Robert | |
| 6,168,387 | B1 | * | 1/2001 | Able et al. | 417/213 |

(Continued)

FOREIGN PATENT DOCUMENTS

| | | |
|---|---|---|
| DE | 32 21 912 | 1/1983 |

(Continued)

OTHER PUBLICATIONS

Notice of Allowance from JP Application No. 2007-201413 dated Sep. 11, 2012.

*Primary Examiner* — Devon Kramer
*Assistant Examiner* — Amene Bayou
(74) *Attorney, Agent, or Firm* — Nixon & Vanderhye P.C.

(57) ABSTRACT

A system and method enable monitoring of a mechanical condition of a reciprocating compressor. The compressor includes a compressor frame, a pressure chamber, and a pressure head. A plurality of tie bolts are secured between the compressor frame and the pressure chamber head. A sensor assembly is secured to one of the plurality of tie bolts. The sensor assembly includes an elongation member positioned to extend in concert with extension of one of the tie bolts. A sensor measures extension of the elongation member to thereby monitor cylinder pressure.

12 Claims, 3 Drawing Sheets

U.S. PATENT DOCUMENTS

| | | | | |
|---|---|---|---|---|
| 6,216,300 | B1 | 4/2001 | Hannagan | |
| 6,292,757 | B1 | 9/2001 | Flanagan et al. | |
| 6,327,912 | B2 * | 12/2001 | Basile et al. | 73/761 |
| 6,484,620 | B2 * | 11/2002 | Arshad et al. | 92/5 R |
| 6,494,343 | B2 | 12/2002 | McManus et al. | |
| 6,957,588 | B1 * | 10/2005 | Kicher et al. | 73/861.52 |
| 7,056,097 | B2 | 6/2006 | Lake | |
| 7,186,094 | B2 * | 3/2007 | Edlund et al. | 417/63 |
| 7,278,310 | B1 * | 10/2007 | Rice et al. | 73/239 |
| 2002/0061254 | A1 * | 5/2002 | Morita et al. | 417/417 |
| 2002/0134794 | A1 | 9/2002 | McManus et al. | |
| 2004/0037689 | A1 * | 2/2004 | Watanabe et al. | 414/730 |
| 2004/0213677 | A1 * | 10/2004 | Matzner et al. | 417/63 |
| 2005/0025631 | A1 | 2/2005 | Lake | |
| 2005/0142012 | A1 * | 6/2005 | Padgett et al. | 417/437 |

FOREIGN PATENT DOCUMENTS

| | | | |
|---|---|---|---|
| JP | 07034305 | A | 2/1995 |
| JP | 2007231823 | A | 9/2007 |

* cited by examiner

SYSTEM AND METHOD FOR MONITORING A RECIPROCATING COMPRESSOR

BACKGROUND OF THE INVENTION

The present invention relates to a system and method for monitoring a mechanical condition of a reciprocating compressor and, more particularly, to a non-invasive system and method that measures dynamic performance of a hyper-compressor cylinder by measuring the inherent operating strain of the compressor assembly.

The production of low-density polyethylene requires the use of very high pressures. Polymerization pressures can reach as high as 50,000 psi. To achieve these pressures, high pressure reciprocating compressors, or hyper-compressors, are used. Monitoring the mechanical condition of the hyper-compressor cylinder components during operation is important for determining maintenance requirements. That is, hyper-compressors are susceptible to similar problems as lower pressure reciprocating compressors, including, for example, valve failure, valve leakage, packing leaks and the like. The plungers used to compress the volatile gas are constructed of materials that have a high compressive strength but are brittle and typically will shatter when breaking. Valve failures can result in undue stress on the compressor running gear because of pressure unbalance or can result in loose pieces of the valve falling into the compressor chamber causing metal-to-metal contact on the plunger face that can cause bending and ultimate failure of the plunger. Such failure results in mechanical destruction of the compressor and in the volatile gases being released, which are susceptible to ignition, thereby causing a safety concern for those working in the vicinity of the compressor. Direct measurement of the high pressures to determine cylinder performance by penetrating the chamber is highly dangerous. Knowledge of the cylinder pressure gives insight into the valve and packing performance and the ability to avert many potentially catastrophic conditions.

The strain measurement of the compressor assembly has been done, as described in U.S. Pat. No. 7056,097, using strain gauges mounted on the head bolts or on the tie bolts, or compressive load measurements between the head and the head-bolt nut. The load measuring system used in the noted publication inserts an apparatus as part of the load bearing structure and is subject to deformation or crushing, which alone could be a safety concern. Externally mounted strain gauges require cleaning of the surface to support a good bond to the stressed element. Additionally, such strain gauges are temperature dependent. Moreover, gauges are small and require protection to survive in an industrial environment and are cyclically stressed when installed on an operating compressor. Clamp-on strain assemblies have been used, but they also require cleaning of the surface, and since the contact area is under stress, the contact surfaces will "creep" over time and under cyclic stress.

BRIEF DESCRIPTION OF THE INVENTION

In an exemplary embodiment of the invention, a system monitors a mechanical condition of a reciprocating compressor. The reciprocating compressor includes a compressor frame, a pressure chamber, and a pressure chamber head, wherein a plurality of tie bolts are secured between the compressor frame and the pressure chamber head. The monitoring system has a sensor assembly secured to one of the plurality of tie bolts, the sensor assembly including an elongation member positioned to extend in concert with extension of the one of the tie bolts and a sensor measuring extension of the elongation member.

In another exemplary embodiment of the invention, a system for monitoring a mechanical condition of a reciprocating compressor includes a rod clamp fixed to one of the plurality of tie bolts; a sensor clamp fixed to the one of the tie bolts and spaced from the rod clamp; a sensor mounted in the sensor clamp; and a target rod fixed to the rod clamp at one end and movably coupled with the sensor clamp at an opposite end proximate to the sensor. Elongation of the one of the tie bolts is measured by sensing, with the sensor, movement of the target rod opposite end relative to the sensor clamp.

In still another exemplary embodiment of the invention, a method of monitoring a mechanical condition of a reciprocating compressor includes the steps of (a) securing a target rod to at least one of the plurality of tie bolts; (b) measuring a target rod movement amount; and (c) correlating the target rod movement amount with a mechanical condition of the reciprocating compressor.

DETAILED DESCRIPTION OF THE INVENTION

Figure 1:
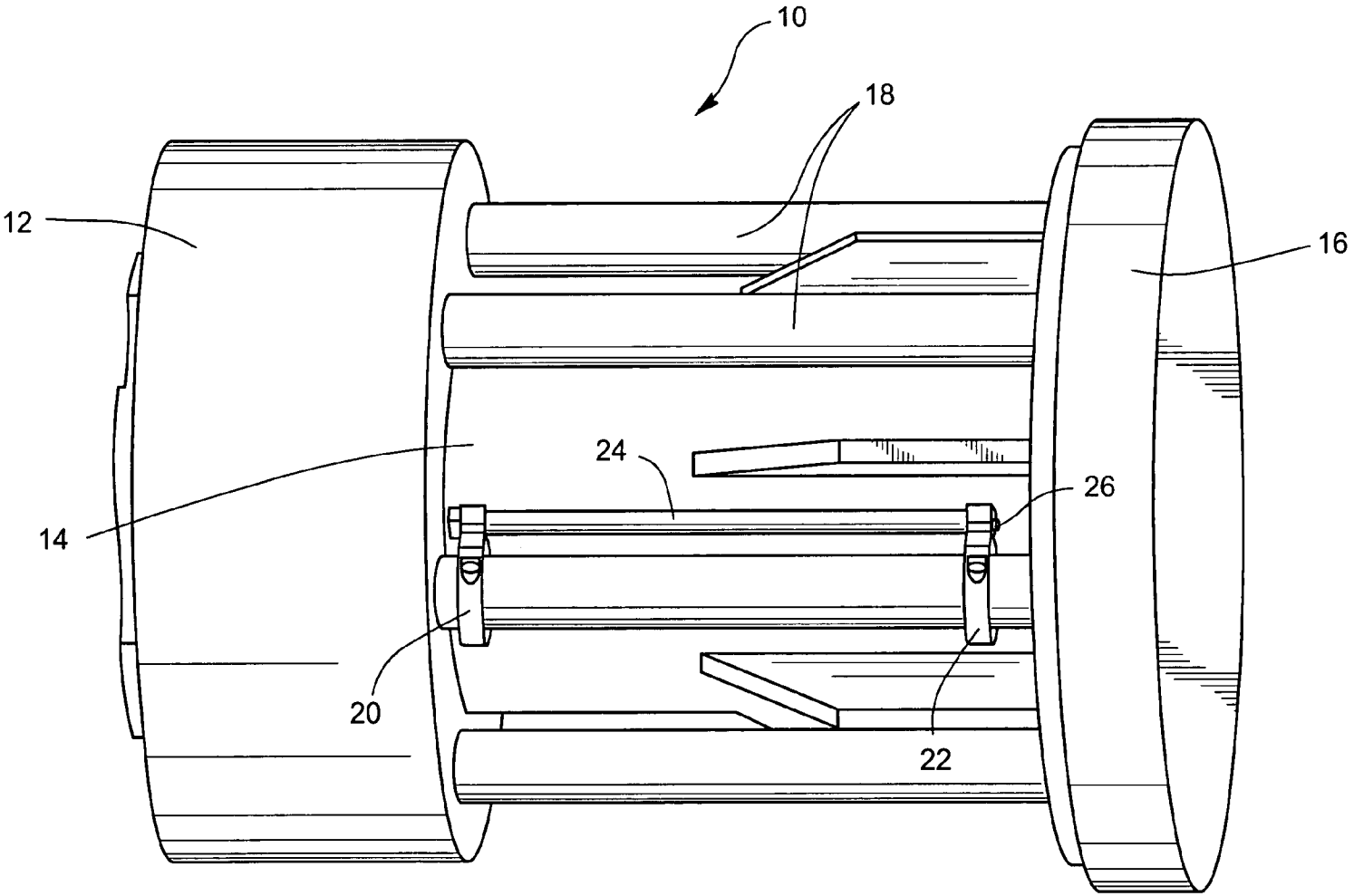
FIG. 1 is a perspective view of an exemplary reciprocating compressor with an attached system for monitoring its mechanical condition.

The system and method described herein uses the inherent strain on some portions of the compressor assembly to determine the cylinder pressure. The inherent strain caused by the pressure results in a lengthening of the compressor structure, and the system described herein measures this change in dimension, which is linearly proportional to pressure. The system uses similar materials to the compressor so that any thermal expansion effects of increased temperatures are compensated for. Measuring the strain over a significant length of the structure allows a substantial increase in sensor sensitivity over a strain gauge that may have a relatively low sensitivity. Multiple sensing systems placed on a cylinder can be summed to add sensitivity and to average any "wag" in the cylinder that may cause unbalanced strain. "Wag" is side-to-side movement of the cylinder assembly that would cause unequal strain on opposite sides of the chamber. There is substantial support and stiffness in the vertical direction, but less in the horizontal direction With reference to FIG. 1, an exemplary high pressure reciprocating compressor 10 is shown. The compressor 10 includes a compressor frame 12, a pressure chamber 14, and a pressure chamber head 16. A plurality of tie bolts 18 are secured between the compressor frame 12 and the pressure chamber head 16. The use and operation of the compressor 10 are known, and details thereof will not be further described.

With continued reference to FIG. 1, the system includes a rod clamp 20, a sensor clamp 22, a target rod 24, and a sensor 26. The rod clamp 20 is fixed to at least one of the plurality of tie bolts 18. The sensor clamp 22 is fixed to the same tie bolt(s) 18 and spaced from the rod clamp 20. A sensor 26, such as a proximity probe or the like, is mounted within the sensor clamp 22. One suitable sensor is the Bently Nevada NSV probe available from the Bently Nevada Corporation of Minden, Nev. An optical or other suitable sensor may alternatively be used. The target rod 24 is fixed to the rod clamp 20 at one end and is movably coupled with the sensor clamp 22 at an opposite end proximate to the sensor 26. Elongation of the tie bolts 18 causes relative movement of the target rod 24 opposite end and the sensor clamp 22.

The rod clamp 20 is preferably a two-piece clamp having an inside diameter slightly smaller than the tie bolt 18 to which the rod clamp 20 is fixed. A protrusion from the clamp is threaded to accept the target rod 24. The target rod is preferably necked down and threaded on one end to fasten to the rod clamp 20 and to be perpendicular to the clamp 20 with the necked down shoulder being perpendicular to the target rod axis.

Figure 3:
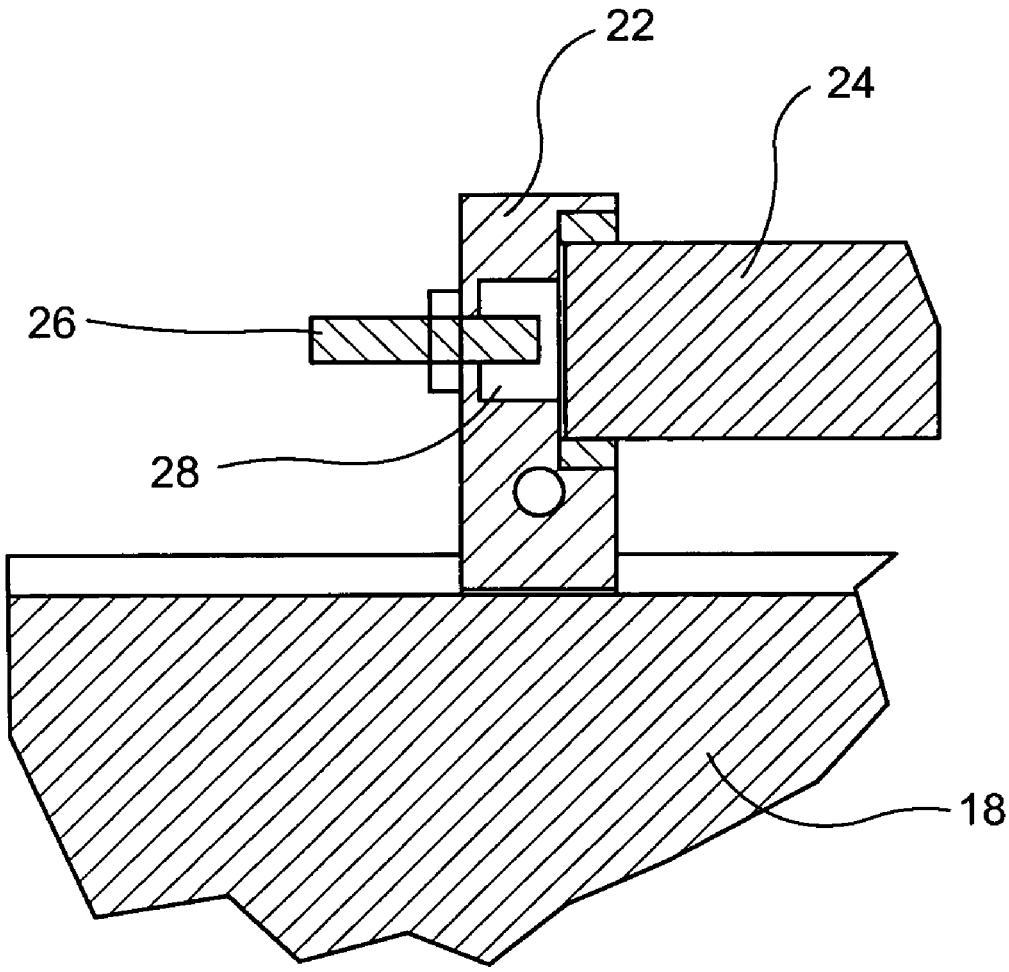
FIG. 3 is a detailed cross sectional view of the monitoring system sensor.

The opposite end of the target rod 24 is perpendicular to the axis of the rod and is used as a measurement target. A circumferential groove on the rod 24 is used to indicate the correct insertion depth into the sensor clamp 22. With reference to FIG. 3, the sensor clamp 22 is similar to the rod clamp 20 except the protrusion contains a cavity 28, lined with a plastic sleeve to accept the target rod 24 and has a threaded length to support the sensor 26. Measurement is made of the sensor clamp position relative to the axial face of the target rod 24.

To install the system, the rod clamp 20 is first placed near one end of the tie bolt 18 and secured to the tie bolt 18 by tightening the clamp bolts. The target rod 24 is then firmly tightened into the rod clamp 20 (parallel to the tie bolt 18). The sensor clamp 22 is then installed on the tie bolt 18 and slid toward the target rod 24 until the target rod extends into the sensor clamp 22 to the depth indicated by the groove on the target rod 24. A sensor 26 is then assembled into the sensor clamp 22, and when inserted to the starting depth, the sensor is firmly secured in place with a jam nut against the sensor clamp 22. The process is repeated for each tie bolt 18 fitted with a device. The described method is exemplary as those of ordinary skill in the art will appreciate alternative methods or differently ordered steps, and the invention is not necessarily meant to be limited to the described method.

Figure 2:
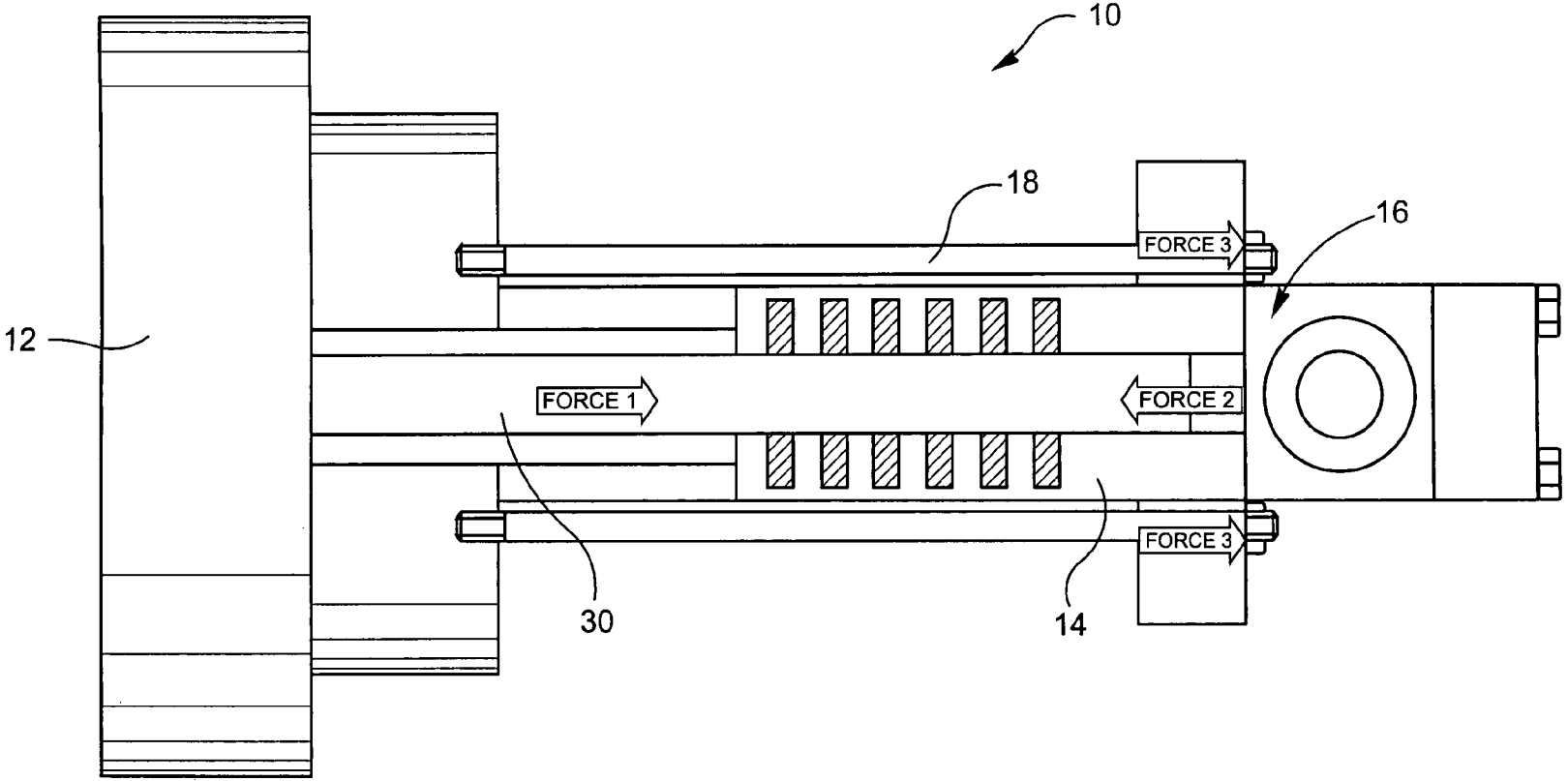
FIG. 2 is a cross sectional illustration showing the operation of the monitoring system.

With reference to FIG. 2, during operation of the compressor, a force on the plunger 30 (force 1) creates gas under pressure in the cylinder in an equal but opposite direction. The resulting stress forces (force 2) are passed from the cylinder head 16 to the supporting tie bolts 18 (force 3) in proportion. This stress results in strain on the tie bolts 18 that causes them to lengthen according to Young's modulus for the bolt material. The total growth between the rod clamp 20 and the sensor clamp 22 is directly related to the growth of the tie bolt 18 between the two clamps 20, 22. Because the target rod 24 is stationary with respect to the rod clamp 20 but able to freely slide in the sensor clamp 22, the distance from the sensor face to the target rod axial face will change the same as the strain induced growth of the tie bolt 18.

The sensor 26 measures this increase in the space between the sensor 26 and the target face of the target rod 24, which is related directly to the strain on the tie bolt 18. The sensor 26 outputs its measurement to a processor such as a CPU or the like, and the processor generates output curves similar in appearance to classical pressure-volume (PV) diagrams, which are used to assess a condition of the compressor.

The compression cycle generates heat, a portion of which is radiated by the compressor cylinder and the head. As the tie bolts 18 are heated, they expand as a result of their coefficient of linear expansion. This thermal growth will also lengthen the distance between the rod clamp 20 and the sensor clamp 22. As the temperature is radiated from the cylinder, the target rod 24 also grows in response to the temperature change, and the growth reduces the distance between the sensor 26 and the target rod face, thus compensating for the ambient temperature of the device and the tie bolts 18. This is an important feature as only measuring the distance between the clamps (for example, with a laser) would not compensate for the thermal growth. The installation of the target rod 24 provides that function.

The balancing of the forces in the tie bolts 18 causes the sum of all of the bolt stress to equal the driving force, although this does not guarantee that it is equally divided among all of the tie bolts 18. The sensor outputs from a number of sensors 26 may be summed to total the force acting on the cylinder.

The monitoring system described herein uses the inherent strain on portions of a compressor assembly to determine cylinder pressure. By monitoring cylinder pressure, valuable information about the valve and packing performance can be obtained, thereby reducing the risk of a catastrophic condition.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A system for monitoring a mechanical condition of a reciprocating compressor, the reciprocating compressor including a compressor frame, a pressure chamber, and a pressure chamber head, wherein a plurality of tie bolts are secured between the compressor frame and the pressure chamber head, the monitoring system comprising a sensor assembly non-invasively secured to one of the plurality of tie bolts, the sensor assembly including a movement member positioned externally of the plurality of tie bolts and extending in concert with extension of the one of the tie bolts and a sensor measuring movement of the movement member relative to the sensor, wherein the sensor assembly comprises a rod clamp and a sensor clamp fixed to and externally of the one of the tie bolts and spaced from each other, and wherein the movement member comprises a target rod connected between the rod clamp and the sensor clamp.

2. A system according to claim 1, wherein the sensor is mounted in the sensor clamp.

3. A system according to claim 1, wherein the target rod is fixed to the rod clamp at one end and movably coupled with the sensor clamp at an opposite end such that the extension of the one of the tie bolts causes the target rod to move relative to the sensor clamp.

4. A system according to claim 2, wherein the sensor is mounted in the sensor clamp proximate to the opposite end of the target rod, the sensor detecting movement of the target rod relative to the sensor clamp.

5. A system according to claim 2, wherein the target rod is formed of a material having similar thermal expansion characteristics to a material of the tie bolts.

6. A system according to claim 1, wherein the movement member is formed of a material having similar thermal expansion characteristics to a material of the tie bolts.

7. A system according to claim 1, comprising multiple sensor assemblies secured to respective ones of the plurality of tie bolts.

8. A system for monitoring a mechanical condition of a reciprocating compressor, the reciprocating compressor including a compressor frame, a pressure chamber, and a pressure chamber head, wherein a plurality of tie bolts are secured between the compressor frame and the pressure chamber head, the monitoring system comprising:

a rod clamp fixed externally and non-invasively to one of the plurality of tie bolts;

a sensor clamp fixed externally and non-invasively to the one of the tie bolts and spaced from the rod clamp;

a sensor mounted in the sensor clamp; and a target rod fixed to the rod clamp at one end and movably coupled with the sensor clamp at an opposite end proximate to the sensor, wherein elongation of the one of the tie bolts is measured by sensing, with the sensor, movement of the target rod opposite end relative to the sensor clamp.

9. A system according to claim 8, wherein the target rod is formed of a material having similar thermal expansion characteristics to a material of the tie bolts.

10. A method of monitoring a mechanical condition of a reciprocating compressor, the reciprocating compressor including a compressor frame, a pressure chamber, and a pressure chamber head, wherein a plurality of tie bolts are secured between the compressor frame and the pressure chamber head, the method comprising:

(a) externally and non-invasively securing a target rod to at least one of the plurality of tie bolts;

(b) measuring a target rod movement amount; and (c) correlating the target rod movement amount with a mechanical condition of the reciprocating compressor.

11. A method according to claim 10, wherein step (a) is practiced by fixing a rod clamp and a sensor clamp spaced from the rod clamp to the one of the tie bolts, and securing the target rod to the rod clamp and the sensor clamp, wherein the target rod is fixed to the rod clamp at one end and movably coupled with the sensor clamp at an opposite end.

12. A method according to claim 11, wherein step (b) is practiced by measuring movement of the target rod opposite end relative to the sensor clamp.

* * * * *